US007484282B2

(12) United States Patent
Flippin

(10) Patent No.: US 7,484,282 B2
(45) Date of Patent: Feb. 3, 2009

(54) METHOD OF MAKING MATTRESSES

(75) Inventor: J. Patrick Flippin, Mebane, NC (US)

(73) Assignee: Kingsdown, Incorporated, Mebane, NC (US)

( * ) Notice: Subject to any disclaimer, the term of this patent is extended or adjusted under 35 U.S.C. 154(b) by 647 days.

(21) Appl. No.: 11/097,388

(22) Filed: Apr. 4, 2005

(65) Prior Publication Data

US 2005/0188517 A1 Sep. 1, 2005

Related U.S. Application Data

(63) Continuation-in-part of application No. 10/403,524, filed on Apr. 1, 2003, now Pat. No. 6,874,215.

(51) Int. Cl.
*B68G 7/00* (2006.01)

(52) U.S. Cl. ..... 29/91.1

(58) Field of Classification Search ..... 29/91.1, 29/91; 112/2.1, 475.06, 475.08
See application file for complete search history.

(56) References Cited

U.S. PATENT DOCUMENTS

| | | | | |
|---|---|---|---|---|
| 2,336,952 | A | 12/1943 | Olson | |
| 3,031,985 | A | 5/1962 | Kalning et al. | |
| 3,173,159 | A | 3/1965 | Hart | |
| 3,641,954 | A | 2/1972 | Kalning et al. | |
| 3,737,929 | A | 6/1973 | Golembeck | |
| 4,019,451 | A | 4/1977 | Autrey | |
| 4,189,797 | A | 2/1980 | Glackin | |
| 4,286,344 | A | 9/1981 | Ikeda | |
| 4,463,466 | A | 8/1984 | May et al. | |
| 5,117,519 | A | 6/1992 | Thomas | |
| 5,475,881 | A | 12/1995 | Higgins et al. | |
| 5,501,164 | A | 3/1996 | Porter et al. | |
| 5,586,511 | A | 12/1996 | Porter et al. | |
| 5,655,241 | A | 8/1997 | Higgins et al. | |
| 5,782,190 | A | 7/1998 | Porter et al. | |
| 6,098,224 | A | 8/2000 | Gladney | |
| 6,263,532 | B1 | 7/2001 | Miller | |
| 6,293,313 | B1 | 9/2001 | McCrink | |
| 6,408,773 | B2 | 6/2002 | Resta | |
| 6,874,215 | B2 * | 4/2005 | Flippin | 29/91.1 |
| 2002/0144352 | A1 | 10/2002 | Freeman et al. | |

* cited by examiner

*Primary Examiner*—John C Hong
(74) *Attorney, Agent, or Firm*—Shoemaker and Mattare

(57) ABSTRACT

A pillow top mattress is made by first folding a mattress core border strip lengthwise to form at least one integral pillow top border, cutting diamond-shaped notches out of the folded edge, and sewing the free edges of the notches together to form mitered corners. The strip is cut to length, and after its ends are joined together to form a band, it is pulled over the mattress core. The border strip is then secured to the core material, and pillow top insulation is added before a pillow top panel is sewn to the free edge of the border strip.

5 Claims, 4 Drawing Sheets

METHOD OF MAKING MATTRESSES

This is a continuation-in-part of application Ser. No. 10/403,524, filed Apr. 1, 2003.

BACKGROUND OF THE INVENTION

This invention relates to an improved method of making mattresses.

A standard mattress comprises a core contained within an attractive fabric envelope. Most commonly, the core includes an inner spring assembly comprising an array of coil springs, covered top and bottom by pads of felt or other material. Alternatively, the core may be made of foam, or closed chambers containing water or air. Whatever the core construction, it is covered by an envelope made of top and bottom pieces of textile fabric whose edges are interconnected by sewing to a fabric border strip that runs around the periphery of the mattress. The seams may be protected by a decorative fabric tape.

Mattresses may, in addition, have a "pillow top" attached to the top of the mattress (and to the bottom also, if the mattress is to be reversible). While the pillow top contains its own padding, distinct from that of the core mattress, it is not separable, and in fact is sewn to the mattress. The pillow top appears to be separate, however, because corners are formed at the top of the mattress border, and at the bottom of the pillow top border, so that a neck is formed in the material. In profile, there is a V-shaped indentation at the mattress-pillow top interface. Although sewn together, the pillow top and the core mattress components are—and appear to be—distinct, being made from separate pieces of cloth and padding. The construction of pillow-top mattresses is complex, and involves a good deal of hand work, plus seam closure steps which require an operator to guide a mobile sewing machine around the periphery of the partially assembled mattress.

A pillow top mattress having, for example, an inner spring core is currently made by the following steps (where the steps numbers match the figures which illustrate them).

1*a*. A pillow top border 10 strip, folded lengthwise, is attached to a strong, inelastic polyester non-woven sheet 12, slightly larger than the inner spring 14, by stitching 16 at an offset distance of about two inches inward from the periphery of the sheet. The person doing the sewing lays out vee-shaped miter notches 18 where the corners are to be, and sews the edges of the miters together to form corner seams 20, during this step.

1*b*. A strip of strong non-woven material ("flange") 22 is then attached to the product of step (1*a*), by two parallel lines of stitching, one (24) at the edge of the sheet, and one (26) between the edge and the stitches applied in step (1*a*).

1*c*. Insulation 28 is applied to the top and bottom of a core 14. Now the product 32 of step (1*b*) is placed over the core and insulation, and is secured to the core by clips applied at intervals of several inches. The assembly is inverted, and a second product 32 is applied in a similar manner (if the mattress is to have pillow tops on both sides; for a non-reversible mattress, the bottom border may be simply seamed to a bottom sheet or quilted panel).

1*d*. Now a core border strip 40 is placed around the inner spring, and the core border strip is connected to the flange 22 by machine sewing which adds a tape 42 over the seam simultaneously.

1*e*. Padding 44 is then adhered to both the top and bottom of the mattress, and a pillow top 46 panel is placed over the padding. The panel is sewn to the top edge of the border strip by a hand-guided track-mounted sewing machine (not shown) which adds a tape 48 to the seam as it unites the materials.

Similar methods are used to produce mattresses not having inner springs, in which case the core border is attached to the core by appropriate alternative methods, such as by adhesion or by anchors attached to the core.

In our U.S. Pat. No. 6,874,215, we disclosed a method for making mitered corners on pillow top mattresses, in which the mattress border strip and the pillow top border strip(s) were separate items, joined by sewing after notches had been cut out of their edges to help form mitered corners. The notches had to be kept in alignment as the sewing was done. We now disclose below a method of forming the mattress border strip and the pillow top border strips as one piece, thus avoiding the need to sew the pieces together, and the need to maintain alignment between the notches. The method described in U.S. Pat. No. 6,874,215 is illustrated in FIGS. 2*a*-2*e*.

SUMMARY OF THE INVENTION

An object of the invention is to simplify the manufacture of pillow-top mattresses, and particularly to reduce the amount of tedious hand cutting and sewing required.

Another object is to reduce the amount of material required to make a pillow-top mattress, in particular to reduce the amount of seam tape required. A related object is to reduce waste.

It is a further object to improve the speed and economy of mattress manufacture.

These and other objects are attained by the method described below.

BRIEF DESCRIPTION OF THE DRAWINGS

In the accompanying drawings.

DESCRIPTION OF THE PREFERRED EMBODIMENT

Figure 1A:
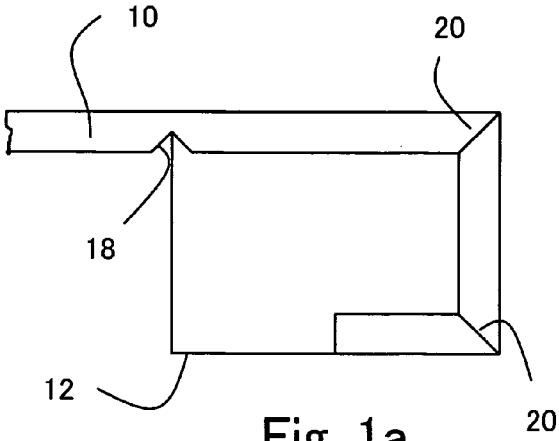
Fig. 1a (PRIOR ART)
FIG. 1*a* is a diagrammatic top plan view of a first step of making a pillow top mattress, according to the current state of the art described above.
Figure 1B:
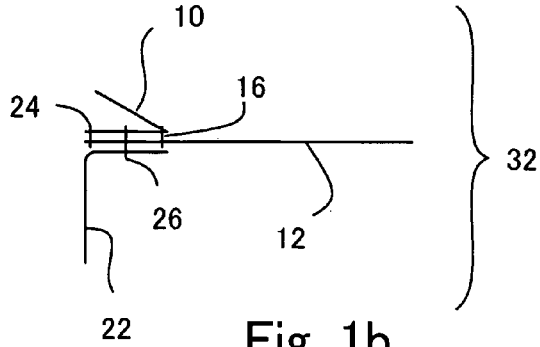
Fig. 1b (PRIOR ART)
FIGS. 1*b*-1*e* are diagrammatic side views showing successive steps of the method.
Figure 1C:
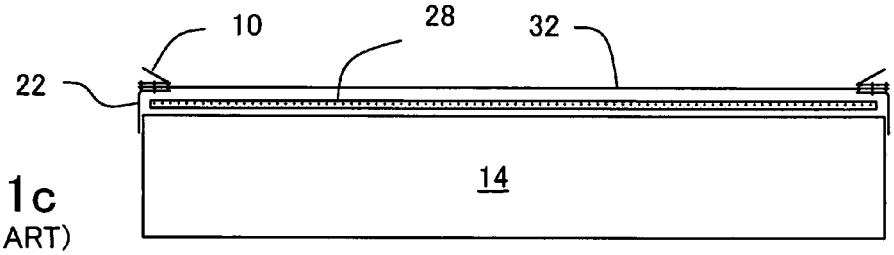
Fig. 1c (PRIOR ART)
Figure 1D:
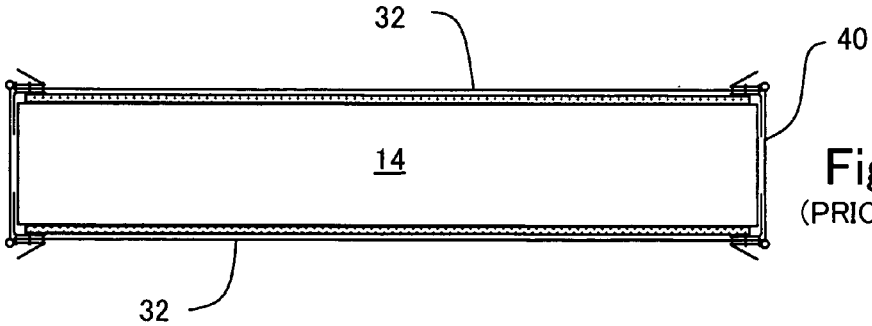
Fig. 1d (PRIOR ART)
Figure 1E:
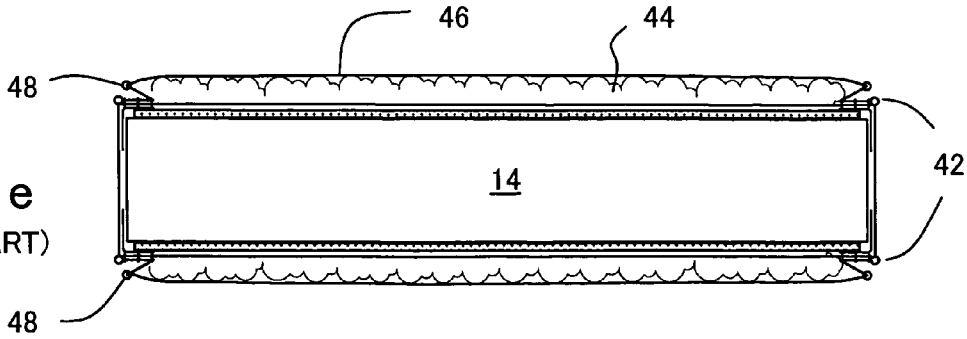
Fig. 1e (PRIOR ART)

As described in our U.S. Pat. No. 6,874,215, a pillow-top mattress is made by the following method steps, shown in correspondingly numbered drawings:

2*a*. Precut miter notches 118 with a machine P along at least one edge of a strip 132 of core border material at intervals determined according to the size of the mattress being produced.

2*b*. Precut miter notches 119 with a machine P' along one edge of a pillow top border strip 110 at the same intervals as in step 2*a*. The separate machines P, P' might be integrated into a single device, or they might actually be the same device, set up to alternately notch pillow top border strips and core border strips.

2*c*. Attach a strip of non-woven material ("flange") 122 to both the pillow top strip 110 and the core border strip 140 by two lines of stitching, one (124) at the aligned edges of the strips, and one (126) offset from the edge about an inch inward. Repeat this step along the other edge of the core border, if making a reversible mattress with two pillow tops, matching the notches of the border strips 110, 140 so that they are laterally opposed. For a single pillow top mattress, the bottom edge of core strip may be mitered at the corners, or it may be subsequently joined by taping to a bottom sheet (not shown) without mitering.

2*d*. Apply padding 128 to the top and bottom of a mattress core 114, which may be an inner spring, or a block of foam, or other material. Now pull the product 132 of step (2*c*) over the core, and secure it to the core, for example to the coils of the inner spring, if one is present, or to the padding material by clips or adhesive or other means, at intervals of several inches.

2*e*. Adhere padding or insulation 144 to both the top and bottom of the mattress, place a pillow top panel 146 over the padding, and close the pillow top with a sewing machine which adds a tape 148 to the seam as it goes. Repeat for the second pillow top, if the mattress is reversible.

Comparing this method with the prior art method discussed previously, one can see that the manufacturing process was considerably simplified. The miter notches were now formed automatically, avoiding the need to lay them out and cut them by hand. The top sheet had been eliminated altogether. The core border and pillow top border(s) could be preassembled before they were applied to the mattress so that, most significantly, the core and border strips did not have to be sewn together after they had been associated with the core. The only seams that needed to be sewn after the core had been added to close the mattress were those around the top edge of the pillow tops(s).

The improvement shown in FIGS. 3*a*-3*d* results in a reversible pillow top mattress having exactly the same external appearance. However, its construction is even simpler, because the mattress border and pillow top borders are integral, and can be notched to make the mitered corners more easily.

Figure 2A:
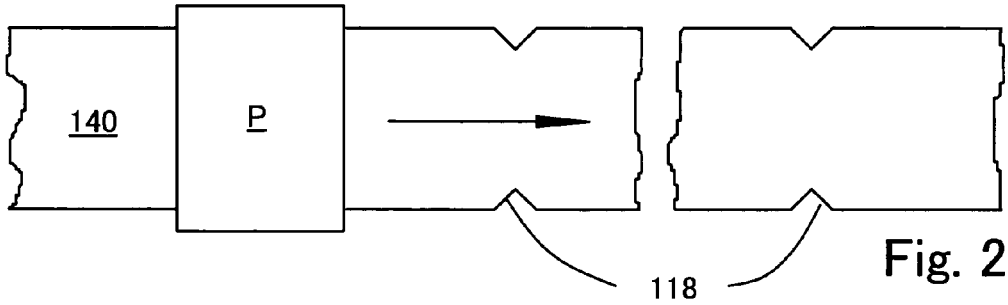
FIGS. 2*a* and 2*b* are diagrammatic top plan views of preliminary steps of making a mattress according to the present invention.
Figure 2B:
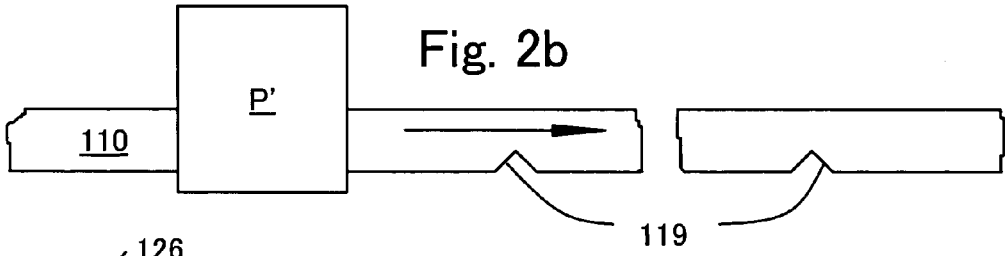
Figure 2C:
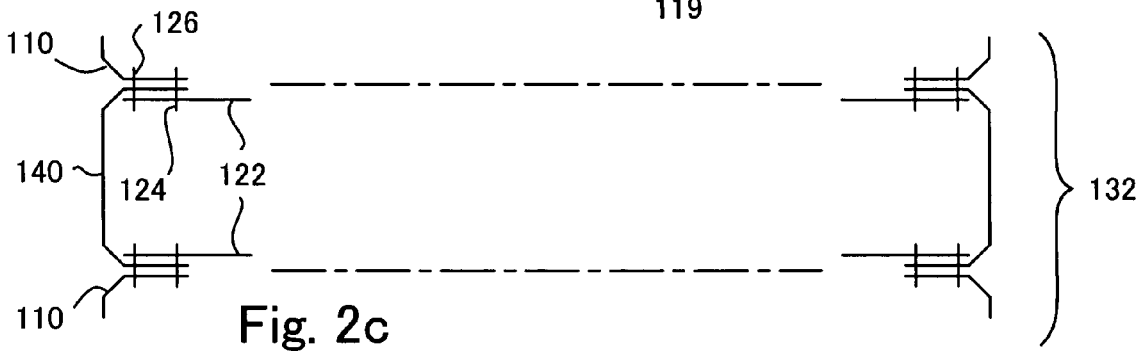
FIGS. 2*c*-2*e* are diagrammatic side views which illustrate the subsequent steps the present invention (described below)
Figure 2D:
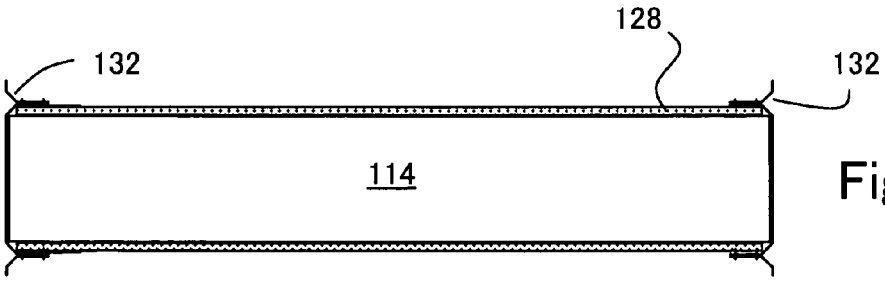
Figure 2E:
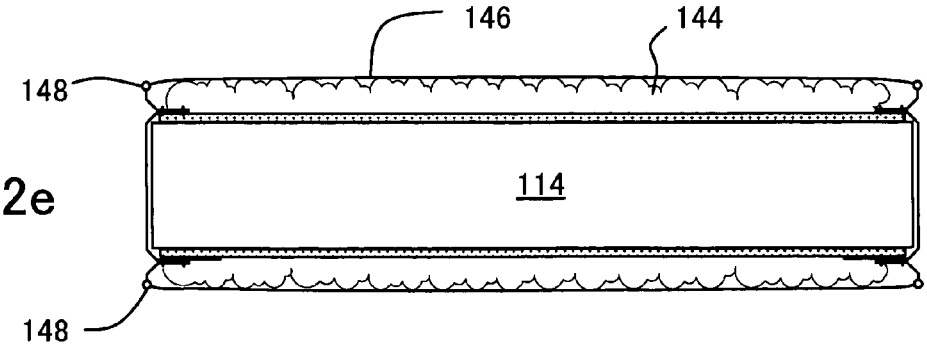
Figure 3A:
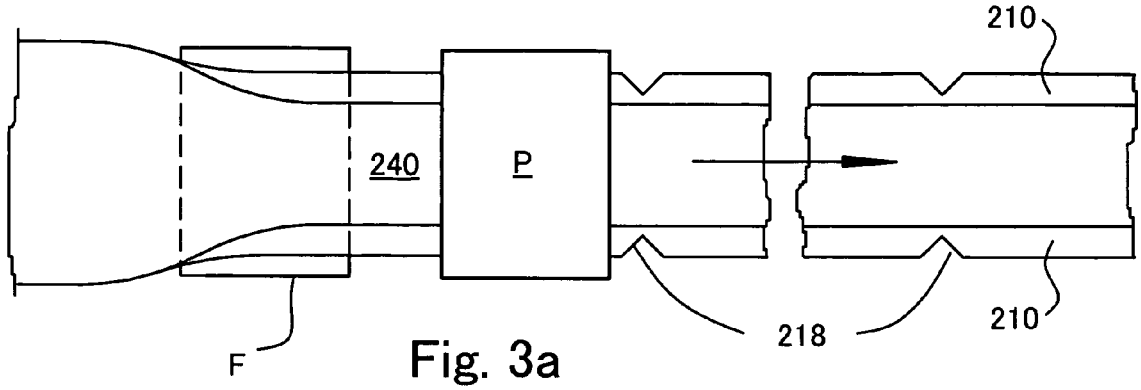
FIGS. 3*a*-3*d* are views corresponding to FIGS. 2*a* and 2*c*-2*e*, showing an improvement in which a single strip of border material is used to form both the mattress border and two pillow top borders, for a reversible mattress.
Figure 3B:
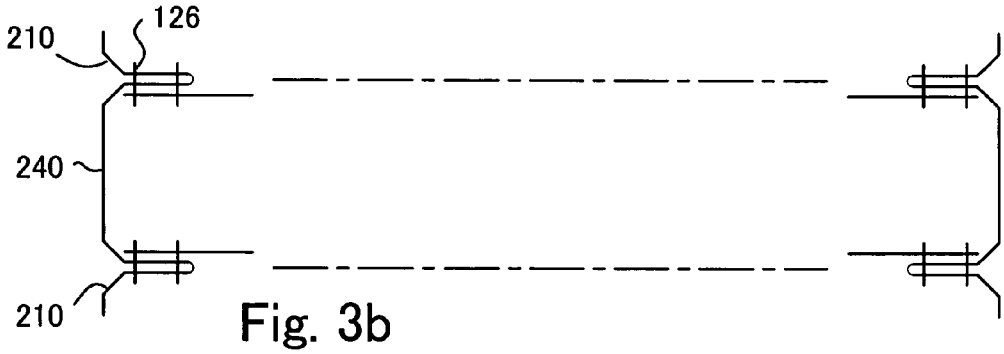
Figure 3C:
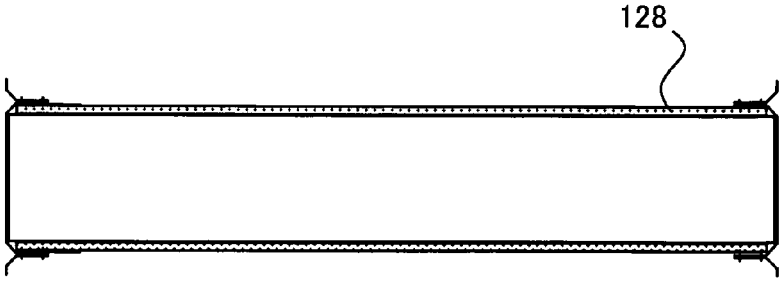
Figure 3D:
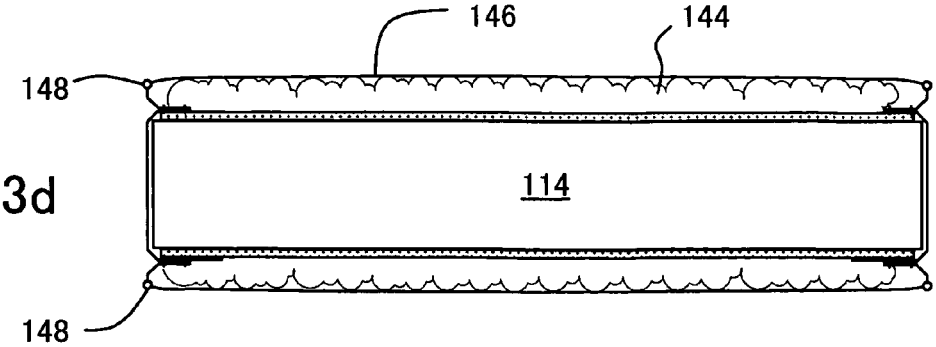
Figure 4A:
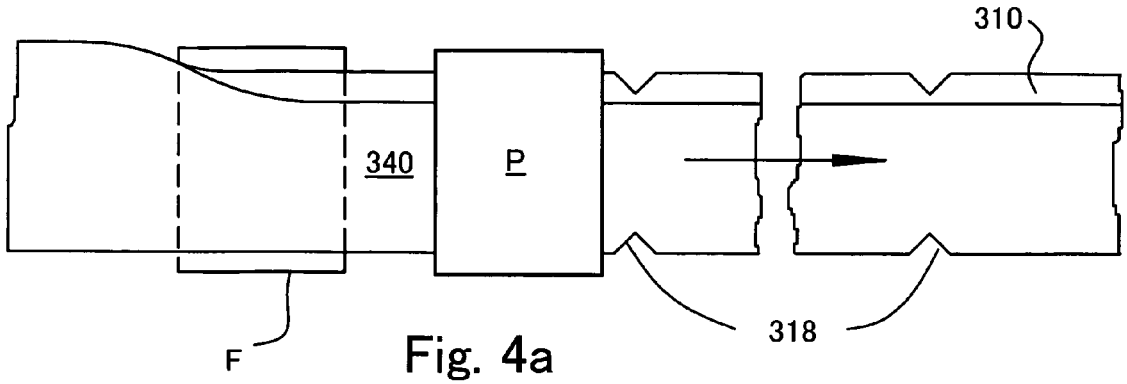
FIGS. 4*a*-4*d* are views corresponding to FIGS. 3*a*-3*d*, showing construction of a single-pillow top mattress according to the principles of the invention.
Figure 4B:
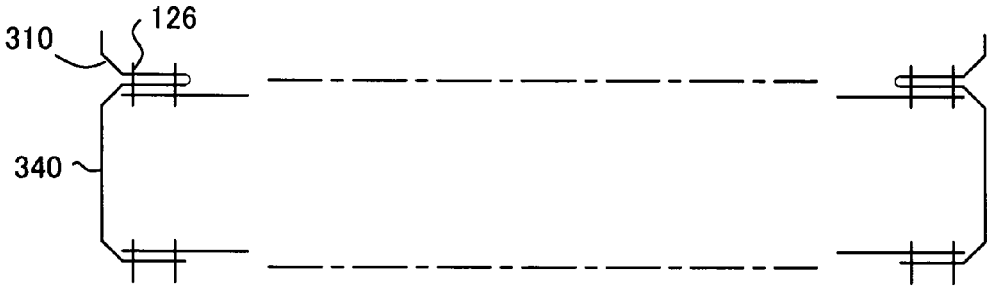
Figure 4C:
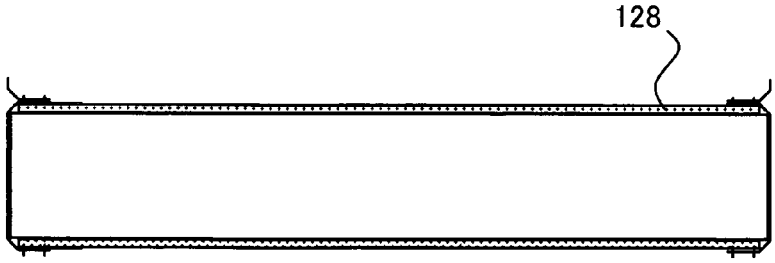
Figure 4D:
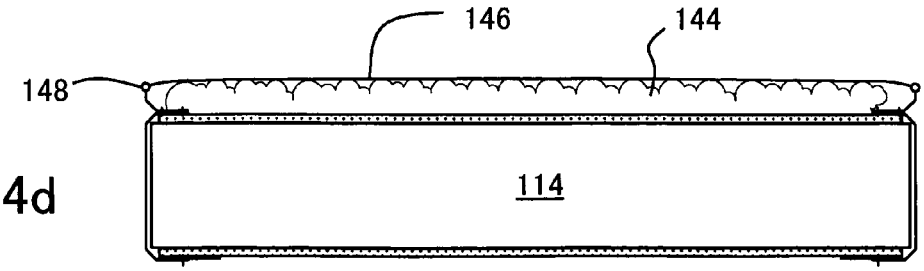

FIG. 3*a* shows an indefinite length of border strip material being fed first through a folding machine F, which folds the strip into appropriate widths for forming the mattress border and the pillow top borders respectively. The lateral edges 210 of the strip, which will become the pillow top borders, are folded over onto the central portion 240 of the strip, which will become the mattress border. From there, the folded material is passed through a notching machine P, which cuts notches 218 from the folded material just as did the machine P in FIG. 2*a*. However, since the edges are folded when cut, a rhomboidal or diamond-shaped aperture is observe if the strip is then unfolded. It is not necessary, actually, to unfold the strip; adjacent pairs of notch edges (each pair lying to one side of the fold line) are drawn together and then united by sewing. The result is an integral strip in which both the mattress border portion and the pillow top border portion are mitered. Once the border is cut to length, and its ends joined together, for example by sewing, to form a rectangular band, it is ready to be installed over a mattress core. The final assembly steps are as described at subparagraphs 2*d* and 2*e* above.

FIGS. 4*a*-4*d* are identical to FIGS. 3*a*-3*e*, except that they show manufacture of a single-side (non-reversible) pillow top mattress. In this case, the strip is folded only once, defining a mattress border portion 340 and a single pillow top border portion 310. Both sides of the folded strip are notched at 318, but of course one of the edges is a free, unfolded edge of the mattress border portion 340.

When the edges of the notches are sewn together, an asymmetrical cross-section (FIG. 4*b*) results. The resulting product is a single pillow top mattress, with an undecorated bottom cover.

Since the invention is subject to modifications and variations, it is intended that the foregoing description and the accompanying drawings shall be interpreted as only illustrative of the invention defined by the following claims.

I claim:

1. A method of making a pillow-top mattress, said method comprising steps of folding a strip of border material lengthwise to form a border strip having folded edges defining a central mattress border portion and lateral pillow top border portions, cutting miter notches along the folded edges of the border strip at intervals determined according to the size of the mattress being produced, drawing adjacent pairs of edges of the notches together and connecting them by sewing, to produce mitered corners in both the mattress border portion and the pillow top border portions, cutting the border strip to length and joining its ends together, pulling the border strip over a mattress core, placing pillow top padding on at least one side of the core, placing a pillow top panel over the padding, and sewing the pillow top panel at its periphery to a free edge of the border strip.

2. A method of making a one-sided pillow-top mattress, said method comprising steps of folding a strip of border material lengthwise to form a mattress border strip having a folded edge, a free edge and a pillow top border portion, cutting miter notches along the folded edge of the border strip, and the free edge of the mattress border portion, at intervals determined according to the size of the mattress being produced, drawing adjacent pairs of edges of the notches together and connecting them by sewing, to produce mitered corners in both the mattress border portion and the pillow top border portions, cutting the border strip to length and joining its ends together, pulling the border strip over a mattress core, placing pillow top padding on one side of the core placing a pillow top panel over the padding, and sewing the pillow top panel at its periphery to the free edge of the pillow top border.

3. The method of claim 2, wherein the folding and notch cutting steps are performed automatically.

4. The method of claim 2, wherein the core comprises an inner spring, and the method comprises a step of connecting the border strip to the inner spring.

5. The method of claim 2, wherein the core comprises a block of foam material.

* * * * *